US012606984B2

(12) United States Patent
Kudo et al.

(10) Patent No.: US 12,606,984 B2
(45) Date of Patent: Apr. 21, 2026

(54) WORKING MACHINE

(71) Applicant: KUBOTA CORPORATION, Osaka (JP)

(72) Inventors: Arisa Kudo, Osaka (JP); Daisuke Yoshida, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 18/960,137

(22) Filed: Nov. 26, 2024

(65) Prior Publication Data

US 2025/0179766 A1 Jun. 5, 2025

(30) Foreign Application Priority Data

Dec. 1, 2023 (JP) ..... 2023-203942

(51) Int. Cl.
*E02F 9/08* (2006.01)

(52) U.S. Cl.
CPC ..... *E02F 9/0858* (2013.01)

(58) Field of Classification Search
CPC ..... E02F 9/0858; E02F 9/163; E02F 9/24
USPC ..... 180/89.1
See application file for complete search history.

(56) References Cited

U.S. PATENT DOCUMENTS

2023/0072461 A1* 3/2023 Yoshida ..... B60N 3/02

FOREIGN PATENT DOCUMENTS

| | | | | |
|---|---|---|---|---|
| EP | 2584100 | A1 * | 4/2013 | ..... E02F 9/0866 |
| JP | 2010-070927 | A | 4/2010 | |
| JP | 2021-195786 | A | 12/2021 | |

OTHER PUBLICATIONS

Computer generated English translation of JP2010070927 to Nakamura (Year: 2025).*
Extended European Search Report, dated Jun. 4, 2025, issued in European Patent Office (EPO) Patent Application No. 24216341.8.

* cited by examiner

*Primary Examiner* — Paul N Dickson
*Assistant Examiner* — Tiffany L Webb
(74) *Attorney, Agent, or Firm* — Greenblum & Bernstein, P.L.C.

(57) ABSTRACT

A working machine includes a traveling device, a machine body turnably supported on the traveling device, a device attached to a swivel board defining a bottom of the machine body, and a guard member provided outward of the device in a machine body width direction to guard the device from an external impact.

10 Claims, 16 Drawing Sheets

WORKING MACHINE

CROSS REFERENCE TO RELATED APPLICATIONS

This application claims the benefit of priority to Japanese Patent Application No. 2023-203942 filed on Dec. 1, 2023. The entire contents of this application are hereby incorporated herein by reference.

BACKGROUND OF THE INVENTION

1. Field of the Invention

The present invention relates to working machines.

2. Description of the Related Art

Hitherto, there is known a working machine disclosed in Japanese Unexamined Patent Application Publication No. 2021-195786 (Patent Document 1).

The working machine disclosed in Patent Document 1 includes a machine body supported on a traveling device to turn freely, and also includes a battery (device) mounted on the machine body. The battery is attached onto a swivel board constituting the bottom of the machine body.

SUMMARY OF THE INVENTION

If the battery is provided, for example, at a portion outward of the swivel board in a machine body width direction, the battery may be damaged by hitting against an obstacle such as a wall, for example, when the machine body makes a turn. In consideration of this, the battery is positioned to avoid an external impact. Therefore, there is a significant layout limitation regarding the position of the battery.

Example embodiments of the present invention provide working machines each of which makes it possible to reduce the limitation on the position of a device mounted on a machine body.

A working machine according to an aspect of an example embodiment of the present invention includes a traveling device, a machine body turnably supported on the traveling device, a device attached to a swivel board defining a bottom of the machine body, and a guard member provided outward of the device in a machine body width direction to guard the device from an external impact.

The guard member may include a contact portion to contact the swivel board such that the swivel board receives the impact applied to the guard member.

The guard member may include an impact receiver to receive the impact. The impact receiver may be provided at a position corresponding to the contact portion in a horizontal direction.

The swivel board may include a plate member and be positioned such that a plate surface thereof faces in an up-down direction. The contact portion may be configured to contact a side surface of the plate member from an outside along the machine body width direction such that a direction in which the contact portion comes into contact with the side surface is perpendicular to or substantially perpendicular to the side surface, the side surface facing outward in the machine body width direction.

The guard member may protrude in a first direction along the machine body width direction from first one of opposite sides of the swivel board in the machine body width direction, and is located inward along the machine body width direction of a first one of opposite sides of the traveling device in the machine body width direction.

The guard member may include a bottom wall located downstream, in a first direction along the machine body width direction, of a first one of opposite sides of the swivel board in the machine body width direction. A portion of the device may be placed on the bottom wall such that the portion is located downstream, in the first direction along the machine body width direction, of the first one of the opposite sides of the swivel board in the machine body width direction.

The device may be provided at one of opposite widthwise outer portions of the swivel board in the machine body width direction. The guard member may include a bottom wall and a first vertical wall extending upward from an outer one of opposite sides of the bottom wall in the machine body width direction. The bottom wall may include a protrusion that is one of opposite widthwise outer portions of the bottom wall in the machine body width direction and protrudes outward along the machine body width direction relative to the first vertical wall. The impact receiver may include a surface of the protrusion that faces outward along the machine body width direction. The contact portion may include a surface of the bottom wall that faces inward along the machine body width direction.

The guard member may include a second vertical wall extending upward from a front portion of the bottom wall and connected to the first vertical wall, and a third vertical wall extending upward from a rear portion of the bottom wall and connected to the first vertical wall.

The working machine may further include a mount attached to the swivel board, the mount being configured to have the device placed and attached thereon. The guard member may include at least one stay stacked on and attached to the swivel board, and an engagement portion to engage with the mount to place a load of the guard member on the mount when the stay is stacked on the swivel board.

The guard member may include a bottom wall and a first vertical wall extending upward from an outer one of opposite sides of the bottom wall in the machine body width direction. A plurality of the stays may be provided. The plurality of the stays may include a first stay extending from a front surface of a second vertical wall and stacked and attached on the swivel board, and a second stay extending from a rear surface of a third vertical wall and stacked and attached on the swivel board. The engagement portion may be provided on a surface of the first vertical wall in that faces inward along the machine body width direction.

The working machine may further include a weight provided at a rear portion of the swivel board. The device may be located at one of opposite portions of the rear portion of the swivel board in the machine body width direction and located forward of one of opposite portions of the weight in the machine body width direction.

The device may include a battery.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 5 is an exploded perspective view of a battery, a battery guard, a mount, and the like.

FIG. 9 is a plan view of the battery guard, the mount, and the like.

FIG. 13 is a rear view of the battery guard and the like.

FIG. 14 is a sectional rear view of the battery guard and the like.

DETAILED DESCRIPTION OF THE EXAMPLE EMBODIMENTS

Figure 1:
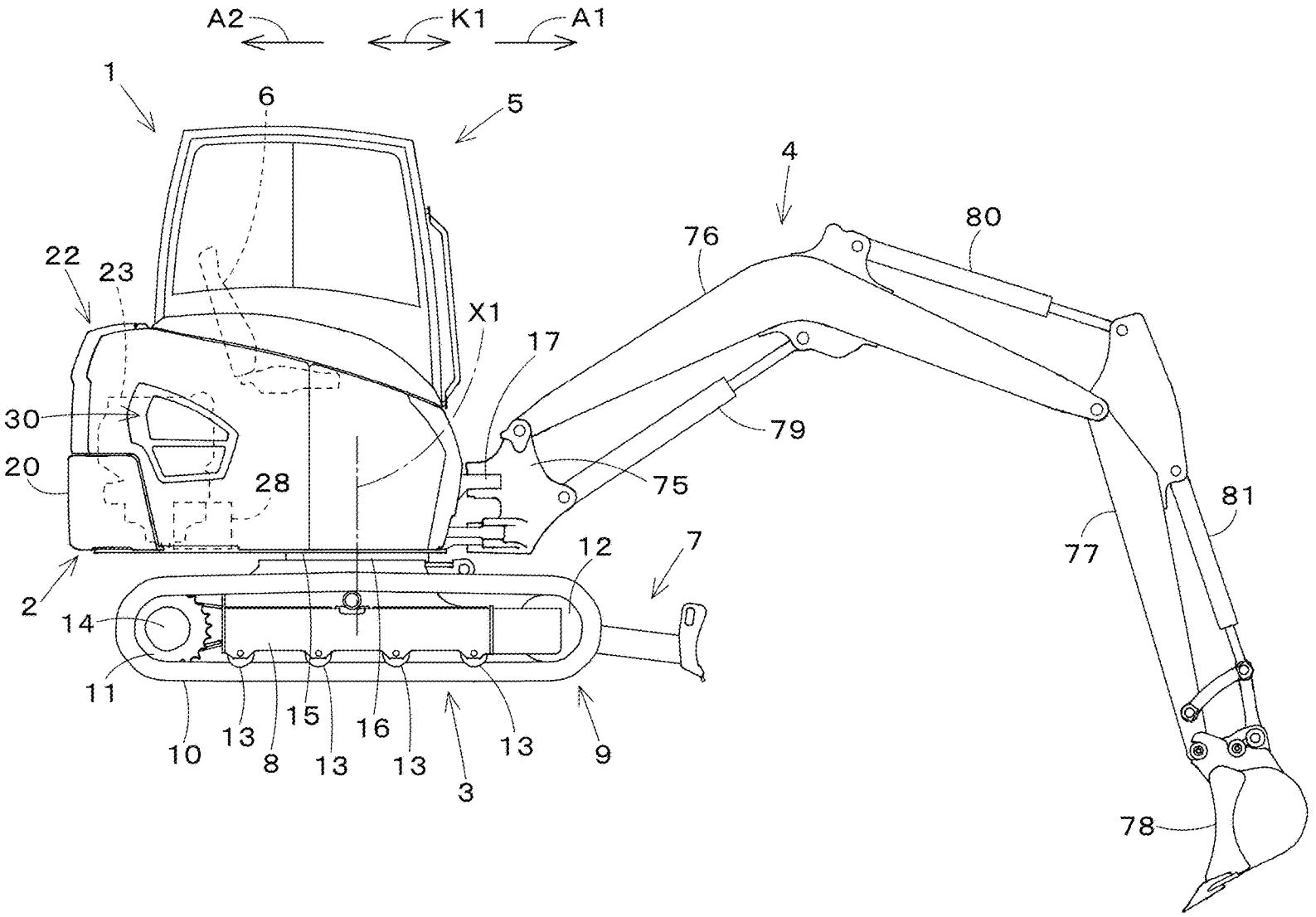
FIG. 1 is a side view of a working machine.

Example embodiments will now be described with reference to the accompanying drawings, wherein like reference numerals designate corresponding or identical elements throughout the various drawings. The drawings are to be viewed in an orientation in which the reference numerals are viewed correctly.

Example embodiments of the present invention are described below with reference to the drawings as appropriate.

Figure 2:
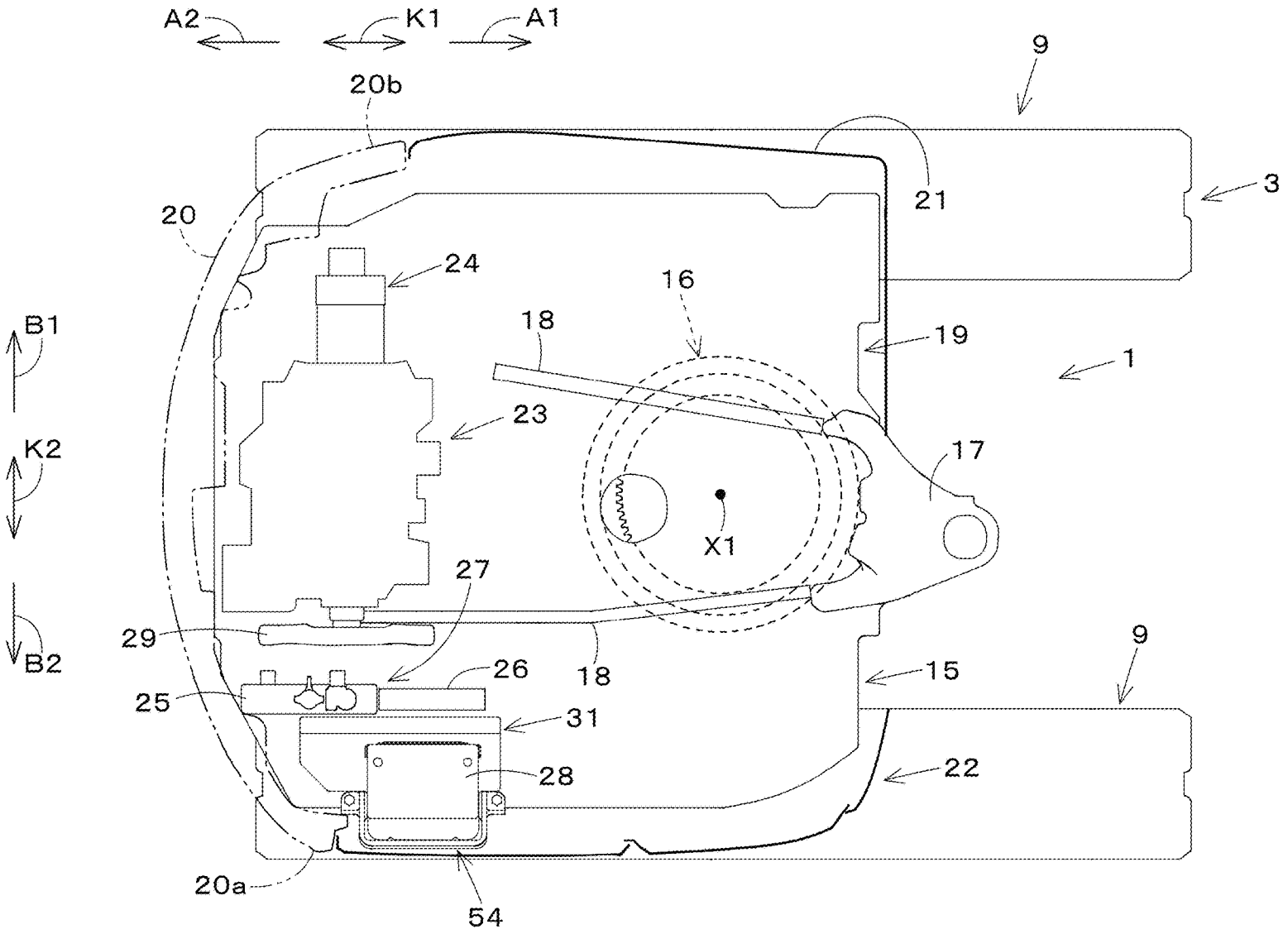
FIG. 2 is a plan view of a machine body and a traveling device.

FIG. 1 is a schematic side view illustrating the overall structure of a working machine 1 according to the present example embodiment. FIG. 2 is a schematic plan view of the working machine 1 from which a working device 4 is omitted. In the present example embodiment, a backhoe that is a turning working machine is exemplified as the working machine 1.

As illustrated in FIGS. 1 and 2, the working machine 1 includes a machine body (turn base) 2, a traveling device 3, and the working device 4. A cabin 5 is mounted on the machine body 2. An operator's seat 6 for an operator to sit on is provided in the cabin 5. The operator's seat 6 is enclosed by the cabin 5.

In the present example embodiment, a forward direction (machine body forward direction) refers to a direction forward of the operator sitting on the operator's seat 6 of the working machine 1 (arrow A1 direction in FIGS. 1 and 2), and a rearward direction (machine body rearward direction) refers to a direction rearward of the operator (arrow A2 direction in FIGS. 1 and 2).

A leftward direction refers to a direction leftward of the operator (direction to the far side in FIG. 1, arrow B1 direction in FIG. 2), and a rightward direction refers to a direction rightward of the operator (direction to the near side in FIG. 1, arrow B2 direction in FIG. 2).

A horizontal direction orthogonal to a longitudinal direction (machine body longitudinal direction) K1 is described as a machine body width direction (lateral direction) K2 (see FIG. 2). A direction to the right or left from the center of the machine body 2 in the width direction is described as an outward machine body width direction. That is, the outward machine body width direction is the machine body width direction K2 away from the center of the machine body 2 in the width direction. A direction opposite to the outward machine body width direction is described as an inward machine body width direction. That is, the inward machine body width direction is the machine body width direction K2 toward the center of the machine body 2 in the width direction.

As illustrated in FIG. 1, the traveling device 3 of the present example embodiment is a crawler traveling device including a traveling frame 8 and traveling mechanisms 9 provided on the right and left of the traveling frame 8. The traveling mechanism 9 is a crawler traveling mechanism in which an endless crawler belt 10 is looped around a drive wheel 11, an idler 12, and a plurality of rolling wheels 13 and a traveling motor 14 drives the drive wheel 11 to rotate so that the crawler belt 10 circulates. The traveling device 3 may be a wheeled traveling device.

A dozer 7 is mounted at the front of the traveling device 3. The machine body 2 is mounted on the traveling frame 8 such that the machine body 2 is turnable to the right and left. Specifically, as illustrated in FIGS. 1 and 2, the machine body 2 includes a swivel board 15 that is a base plate constituting the bottom of the machine body 2. The swivel board 15 is formed using a thick plate member, and is provided such that the plate surface is oriented in an up-down direction. The swivel board 15 is supported on the traveling frame 8 rotatably about an axis extending in the up-down direction (turn axis X1) via a turn bearing 16. In this way, the machine body 2 is turnably supported on the traveling frame 8.

As illustrated in FIG. 2, the turn axis X1 is located at the front of the machine body 2 (swivel board 15) and substantially at the center in the machine body width direction K2. The machine body 2 includes a turn frame 19 including the swivel board 15, a support bracket 17 fixed to the front of the swivel board 15 to protrude forward, and a pair of longitudinal ribs 18 extending rearward from the right and left at the rear of the support bracket 17 and fixed to the swivel board 15.

As illustrated in FIG. 1, a swing bracket 75 is supported on the support bracket 17 swingably about an axis extending in the up-down direction. The working device 4 is attached to the swing bracket 75.

As illustrated in FIG. 1, the working device 4 includes a boom 76, a boom cylinder 79, an arm 77, an arm cylinder 80, a working tool (bucket) 78, and a working tool cylinder (bucket cylinder) 81. The base of the boom 76 is pivotally coupled to the swing bracket 75 such that the boom 76 is swingable in the up-down direction. The boom cylinder 79 extends or contracts to drive the boom 76 to swing. The arm 77 is pivotally coupled to the distal end of the boom 76 to be swingable in the longitudinal direction K1. The arm cylinder 80 extends or contracts to drive the arm 77 to swing. The working tool 78 is pivotally coupled to the distal end of the arm 77 to be swingable in the longitudinal direction K1. The working tool cylinder 81 extends or contracts to drive the working tool 78 to swing. In the present example embodiment, the bucket is exemplified as the working tool 78.

The machine body 2 includes a weight 20 attached to the rear portion of the turn frame 19 (swivel board 15), and a turn cover 21 (see FIG. 2) that covers the left side portion and the left front portion of the turn frame 19 below the cabin 5.

As illustrated in FIG. 2, the weight 20 extends from one of opposite sides (right) of the swivel board 15 in the machine body width direction K2 to the other of the opposite sides (left) of the swivel board 15 in the machine body width direction K2 via the rear of the swivel board 15. The front end of one of opposite portions (first portion) 20*a* of the weight 20 is located rearward of the front end of the other of the opposite portions (second portion) 20*b* of the weight 20.

The machine body 2 includes a hood 22 that covers various devices, various apparatuses, and the like mounted on the machine body 2 (provided above the turn frame 19). The hood 22 defines the right front surface and the right side surface of the machine body, the upper surfaces of the right portion and the rear portion, and the rear surface above the weight 20.

The various devices, the various apparatuses, and the like are a prime mover 23 including various types of engine, motor, or the like, a pump unit 24 including a plurality of pumps that delivers a hydraulic fluid for actuating a hydraulic actuator, a pilot hydraulic fluid for actuating a valve, and a hydraulic fluid for signals, a cooler unit 27 including coolers such as a radiator 25 and an oil cooler 26, a battery (device) 28 that supplies electric power to electrical equipment or the like, a fuel tank that stores fuel for the prime mover 23, and a hydraulic fluid tank that stores a hydraulic fluid.

As illustrated in FIG. 2, the prime mover 23 is provided forward of the weight 20 and at an intermediate portion of the rear portion of the swivel board 15 in the machine body width direction K2. The pump unit 24 is attached to the side (left) of the prime mover 23 in the machine body width direction K2. The cooler unit 27 is provided at one of opposite side (right side) of the prime mover 23 in the machine body width direction K2. A cooling fan 29 provided between the prime mover 23 and the cooler unit 27 is attached to the prime mover 23. The cooling fan 29 is driven by a driving force of the prime mover 23. The cooling fan 29 is a suction fan that sucks air from the right side of the cooler unit 27 to generate cooling air to flow toward the prime mover 23. An outside air inlet 30 (see FIG. 1) through which outside air is taken into the hood 22 is provided at the rear of the right surface of the hood 22.

Figure 7:
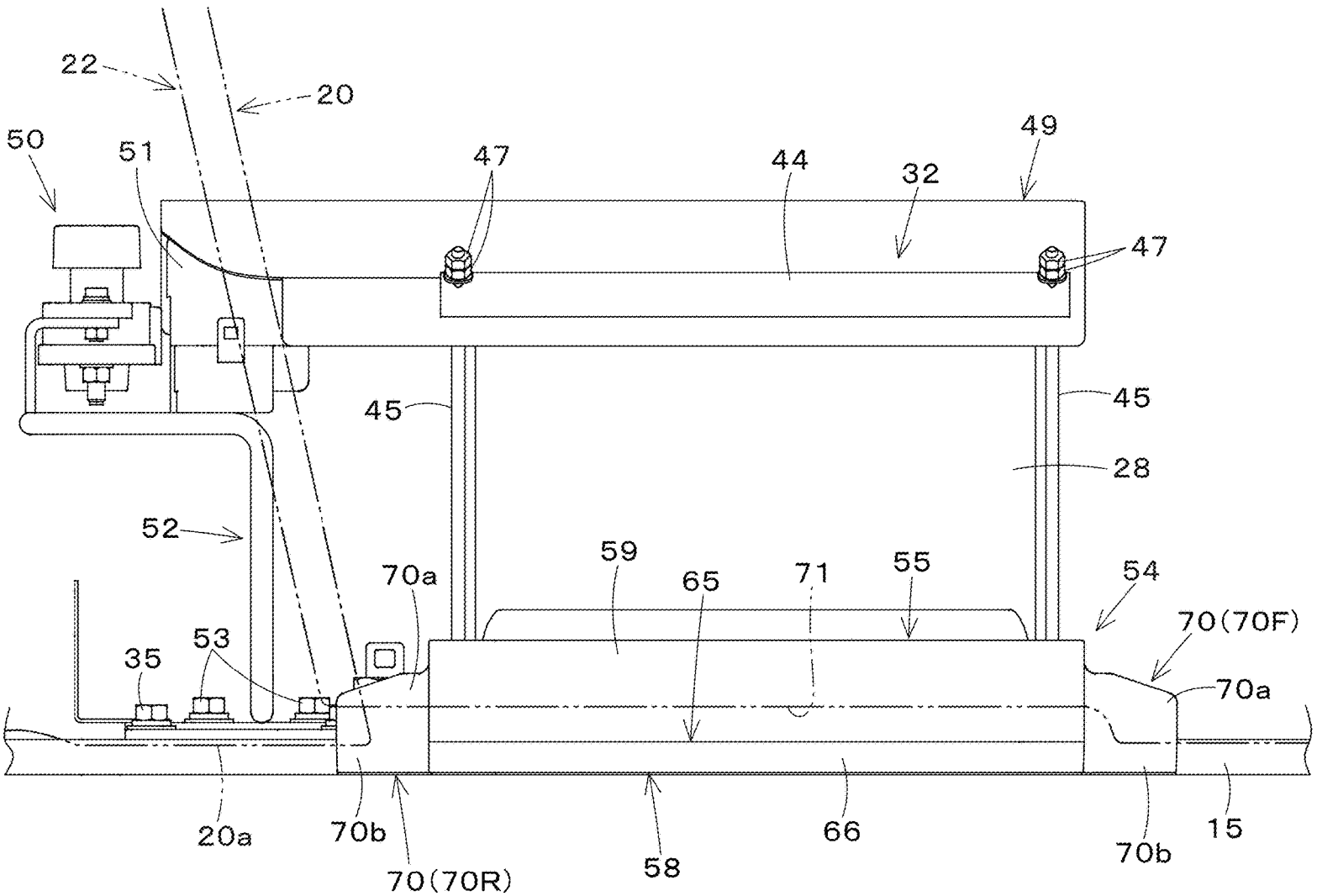
FIG. 7 is a side view of the portion where the battery is provided.
Figure 8:
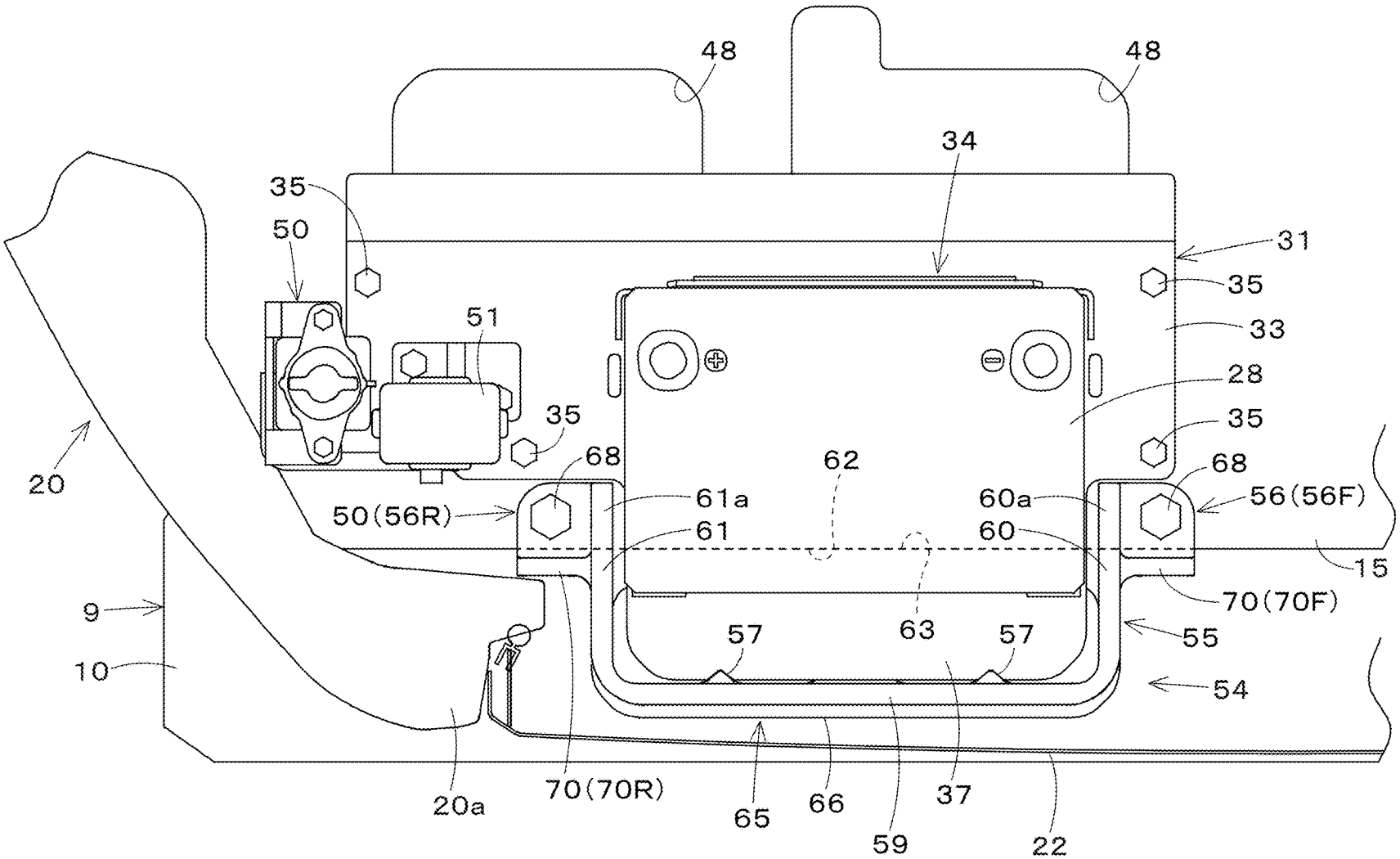
FIG. 8 is a plan view of the portion where the battery is provided.

As illustrated in FIG. 2, the battery 28 is located at one of opposite portions (right portion) of the rear portion of the swivel board 15 in the machine body width direction K2. As illustrated in FIGS. 2, 7, and 8, the battery 28 is located forward of the first portion 20*a* of the weight 20. As illustrated in FIGS. 2 and 8, the battery 28 is located inward of the right end of the right traveling mechanism 9 (crawler belt 10) in the machine body width direction.

The battery 28 is provided rightward of the cooler unit 27 (outward in the machine body width direction). By providing the battery 28 upstream of the cooler unit 27 for the cooling air, the battery 28 can be cooled by the cooling air generated by the cooling fan 29.

Figure 3:
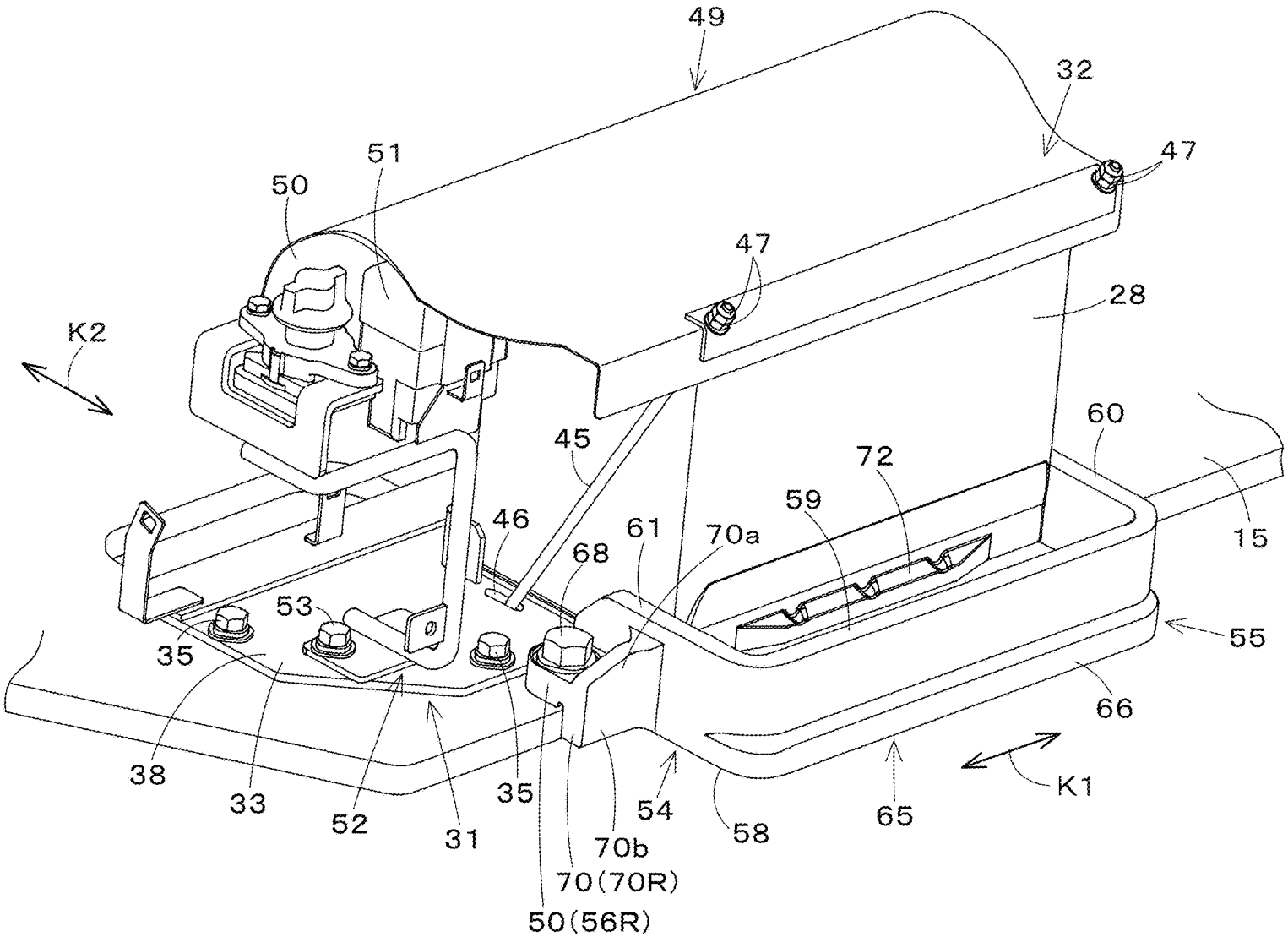
FIG. 3 is a perspective view of a portion where a battery is provided as viewed obliquely from rear right.
Figure 4:
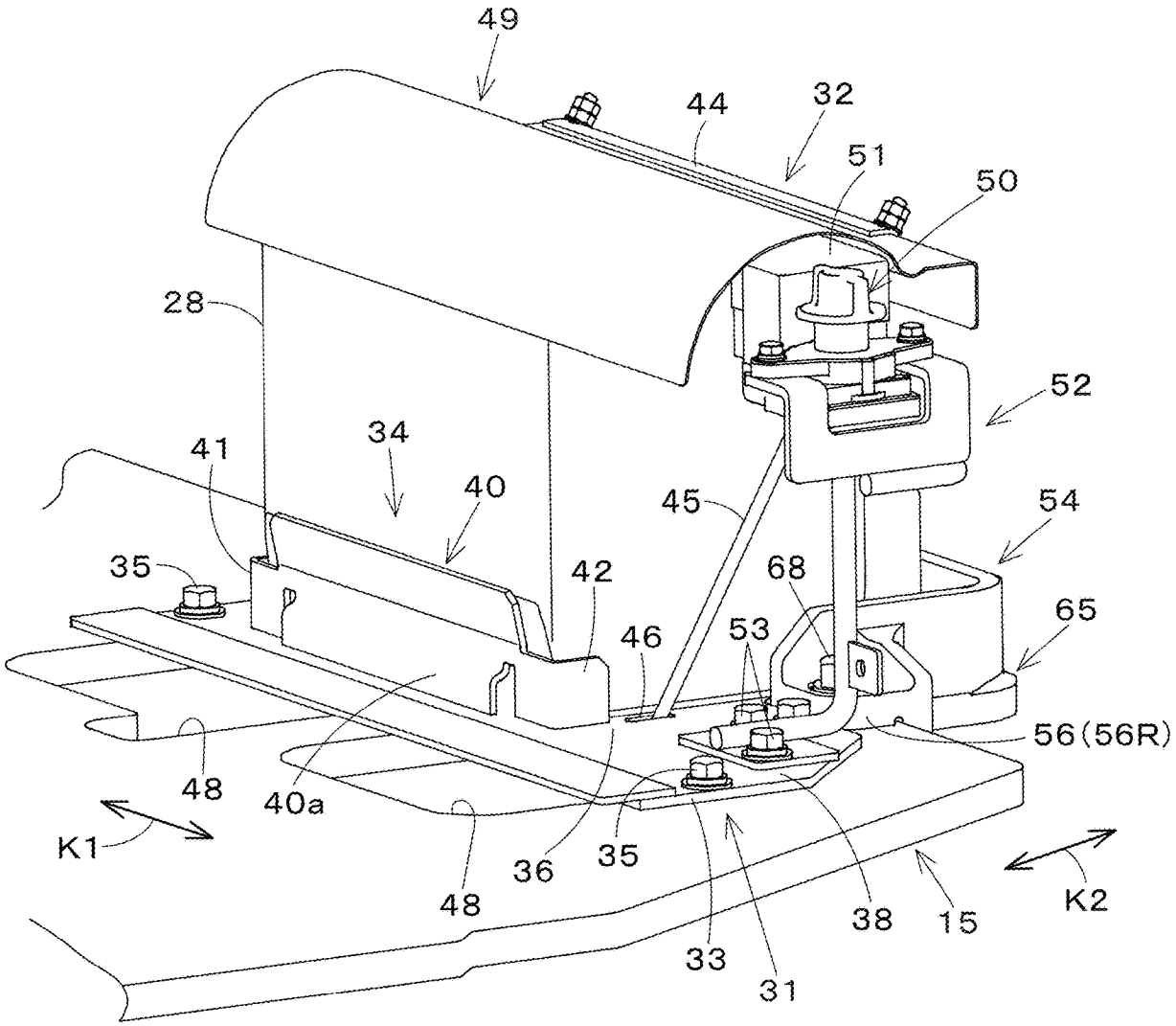
FIG. 4 is a perspective view of the portion where the battery is provided as viewed obliquely from rear left.

As illustrated in FIGS. 3 and 4, the battery 28 is attached to the swivel board 15. In the present example embodiment, the battery 28 is attached to the swivel board 15 via a mount 31. Specifically, the mount 31 is fixed onto the swivel board 15, and the battery 28 is placed on the mount 31 and fixed by a retainer 32. The shape and structure of the mount 31 are not limited to those in the present example embodiment.

Figure 5:
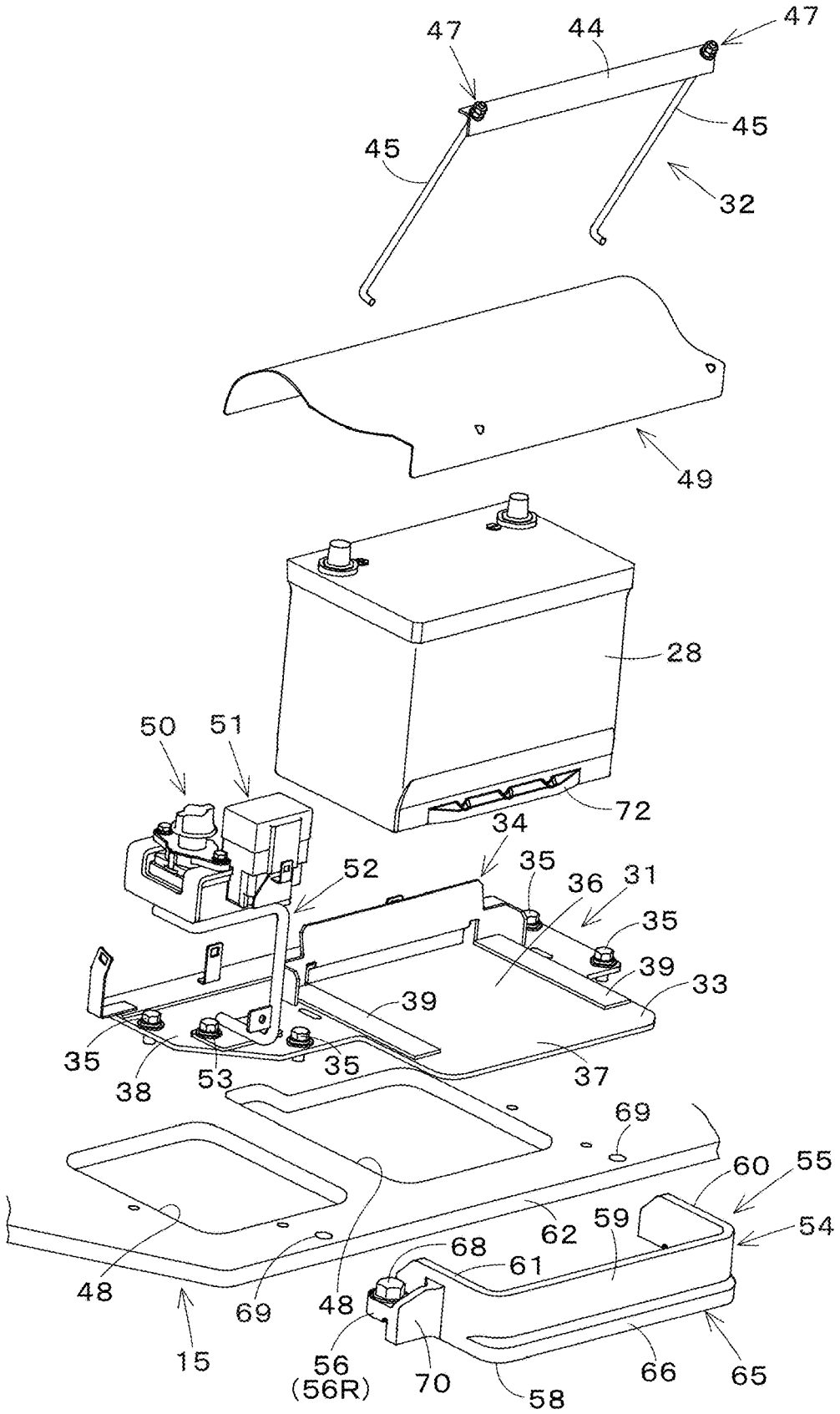
Figure 9:
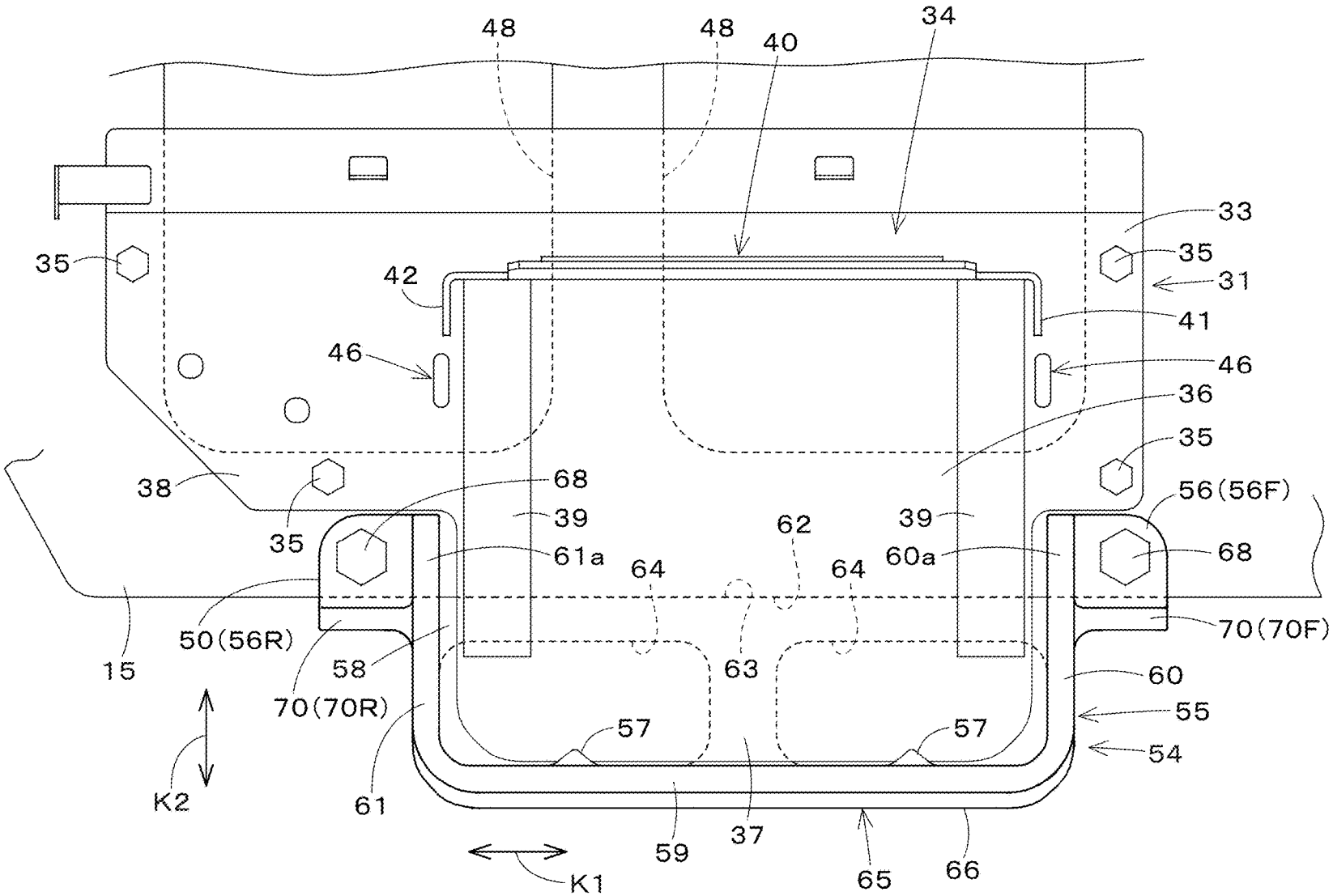

As illustrated in FIGS. 4, 5, and 9, the mount 31 includes a base member 33 and a restriction member 34. The base member 33 is formed using a flat plate member, provided such that the plate surface is oriented in the up-down direction, and fixed to the swivel board 15 with bolts 35.

As illustrated in FIG. 9, the base member 33 includes a stage 36 where the battery 28 is placed, an extension 37 extending in the outward machine body width direction (rightward direction) from the stage 36, and a bracket attachment 38 located rearward of the stage 36.

Figure 6:
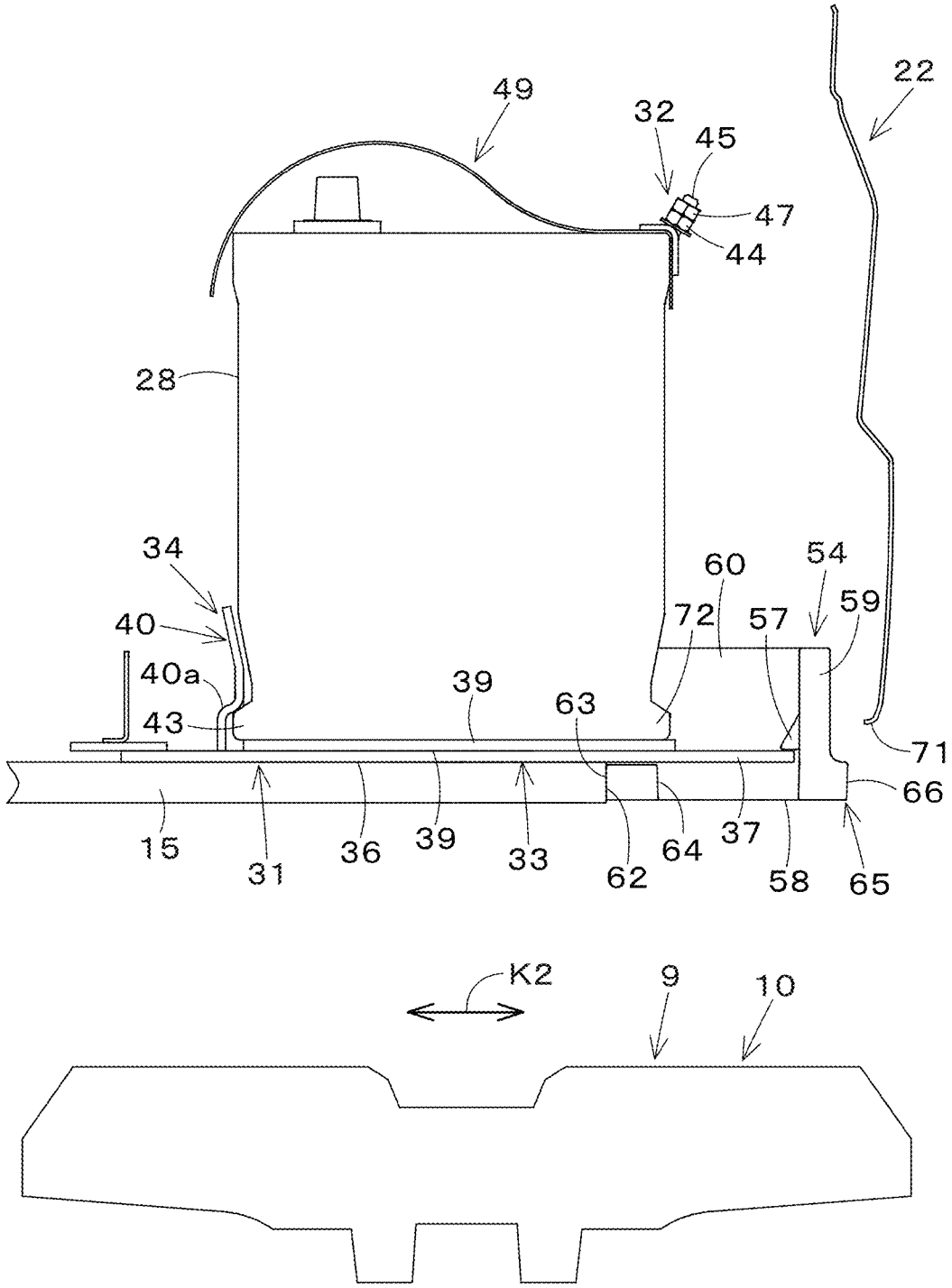
FIG. 6 is a sectional rear view of the portion where the battery is provided.

As illustrated in FIGS. 5 and 9, cushions 39 are bonded to the front and rear of the stage 36, and the battery 28 is placed on the stage 36 via the cushions 39 (see FIG. 6).

As illustrated in FIG. 6, the left portion and an intermediate portion of the stage 36 in the machine body width direction K2 are each stacked (placed) on the swivel board 15. The right portion of the stage 36 protrudes rightward from the right end of the swivel board 15 (end of the swivel board 15 in a direction along the plate surface). Thus, the right portion of the battery 28 projects rightward from the right end of the swivel board 15. The extension 37 is located rightward of the battery 28 and the swivel board 15.

As illustrated in FIG. 6, the restriction member 34 is provided leftward of the stage 36 (leftward of the battery 28 placed on the stage 36) and fixed onto the base member 33 by welding or the like. As illustrated in FIGS. 4 and 9, the restriction member 34 includes a main plate 40 that extends in the longitudinal direction K1 and restricts leftward movement of the battery 28, a first side plate 41 that extends rightward from the front of the main plate 40 and restricts forward movement of the battery 28, and a second side plate 42 that extends rightward from the rear of the main plate 40 and restricts rearward movement of the battery 28.

As illustrated in FIG. 4, the main plate 40 includes a restrictor 40*a* formed by cutting up a plate member constituting the main plate 40. As illustrated in FIG. 6, the restrictor 40*a* engages with a first engagement protrusion 43 formed at the lower portion of the battery 28 to restrict upward movement of the battery 28.

As illustrated in FIGS. 5 and 7, the retainer 32 includes a holding member 44 that holds the battery 28, and a pair of front and rear rod members 45 provided forward and rearward of the battery 28. The holding member 44 is angled and holds the corner between the upper and right surfaces of the battery 28. The upper portion of the rod member 45 passes through the holding member 44, and the lower portion of the rod member 45 is inserted through an insertion hole 46 (see FIG. 9) formed in the base member 33 to engage with the lower surface of the base member 33. Fixing nuts 47 engage with external threads formed at the upper portions of the rod members 45, and the fixing nuts 47 are tightened. Thus, the battery 28 is pushed against the stage 36 (base member 33) and the restriction member 34 and fixed to the mount 31. As illustrated in FIG. 9, the swivel board 15 has through holes 48 for weight reduction, and the insertion holes 46 are formed at positions corresponding to the through holes 48.

As illustrated in FIGS. 3 and 4, a battery cover (device cover) 49 that covers the top of the battery 28 is provided above the battery 28. As illustrated in FIG. 6, the battery cover 49 is attached to the battery 28 by interposing the right portion of the battery cover 49 between the battery 28 and the holding member 44.

As illustrated in FIG. 3, a bracket member 52 to which a disconnector 50 and a fuse box 51 are attached are attached to the bracket attachment 38 with a fastener (bolt and nut) 53. The disconnector 50 is a battery disconnector switch that interrupts current supply from the battery 28, for example, at the time of abnormality, emergency, or maintenance. The fuse box 51 houses, for example, a slow-blow fuse having characteristics that the fuse does not blow by an instantaneous current but blows when a large current flows continuously.

When the swivel board 15 pivots counterclockwise in FIG. 2 about the turn axis X1, the battery 28 moves about the turn axis X1 together with the swivel board 15. In this case, the battery 28 may come into contact with an obstacle such as a wall and an external impact may be applied to the battery 28. In the present example embodiment, a battery guard (guard member) 54 that guards the battery 28 from the external impact is provided as illustrated in FIG. 3. By providing the battery guard 54, the battery 28 can be guarded from the external impact, and limitation on the position of the battery 28 can be reduced.

As illustrated in FIGS. 3 and 8, the battery guard 54 is provided outward (rightward) of the battery 28 in the machine body width direction. As illustrated in FIGS. 6 and 8, the battery guard 54 protrudes in a first direction (rightward direction) along the machine body width direction K2 from a first one of opposite sides of the swivel board 15) in the machine body width direction K2 (protrudes rightward from the right side of the swivel board 15). The battery guard 54 is located inward along the machine body width direction K2 of a first one of opposite sides (right side) of the traveling device 3 in the machine body width direction K2.

As illustrated in FIGS. 6 and 8, the battery guard 54 includes a bottom wall 58 located downstream, in a first direction along the machine body width direction K2, of a first one of opposite sides of the swivel board 15 in the machine body width direction K2 (located rightward of the right side of the swivel board 15), and a portion of the device 28 is placed on the bottom wall 58 such that the portion is located downstream, in the first direction along the machine body width direction K2, of the first one of the opposite sides of the swivel board 15 in the machine body width direction K2 (located rightward of the right side of the swivel board 15).

Next, the structure of the battery guard 54 is described in detail.

Figure 10:
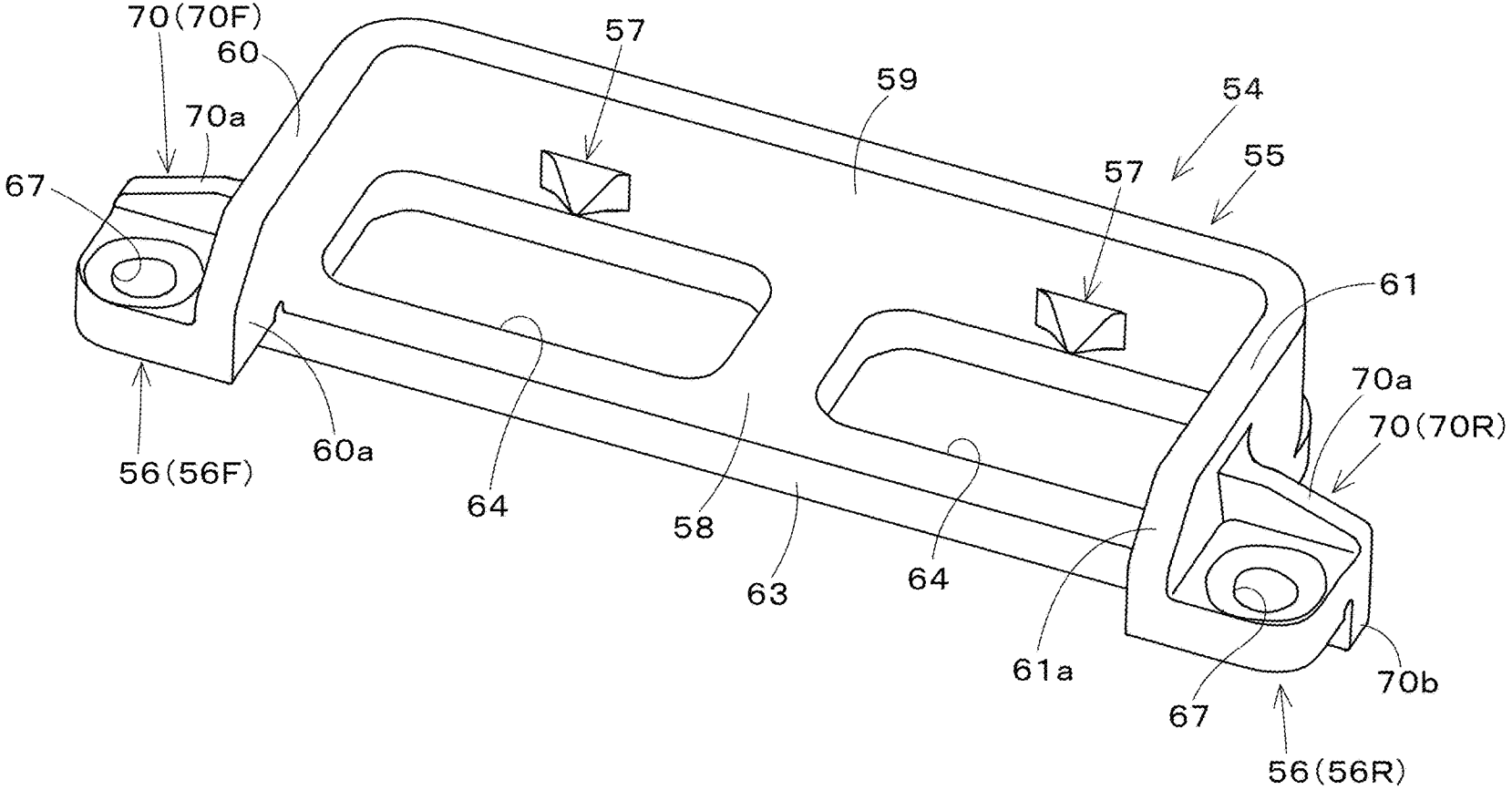
FIG. 10 is a perspective view of the battery guard.
Figure 11:
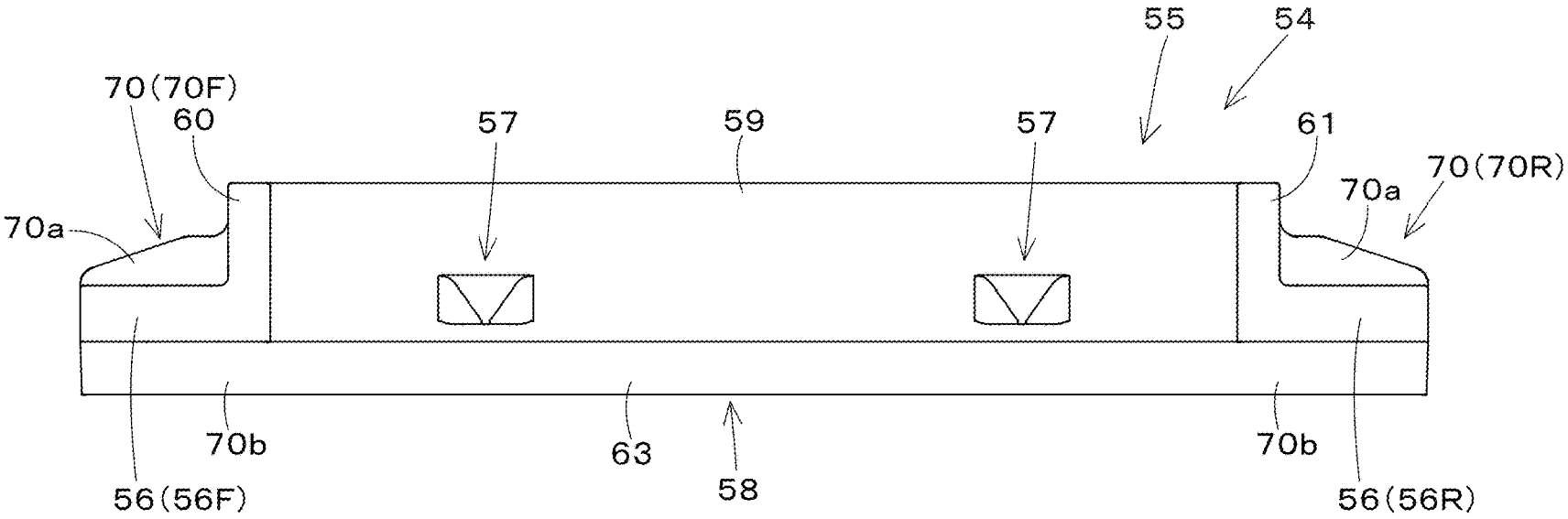
FIG. 11 is a side view of the battery guard.
Figure 12:
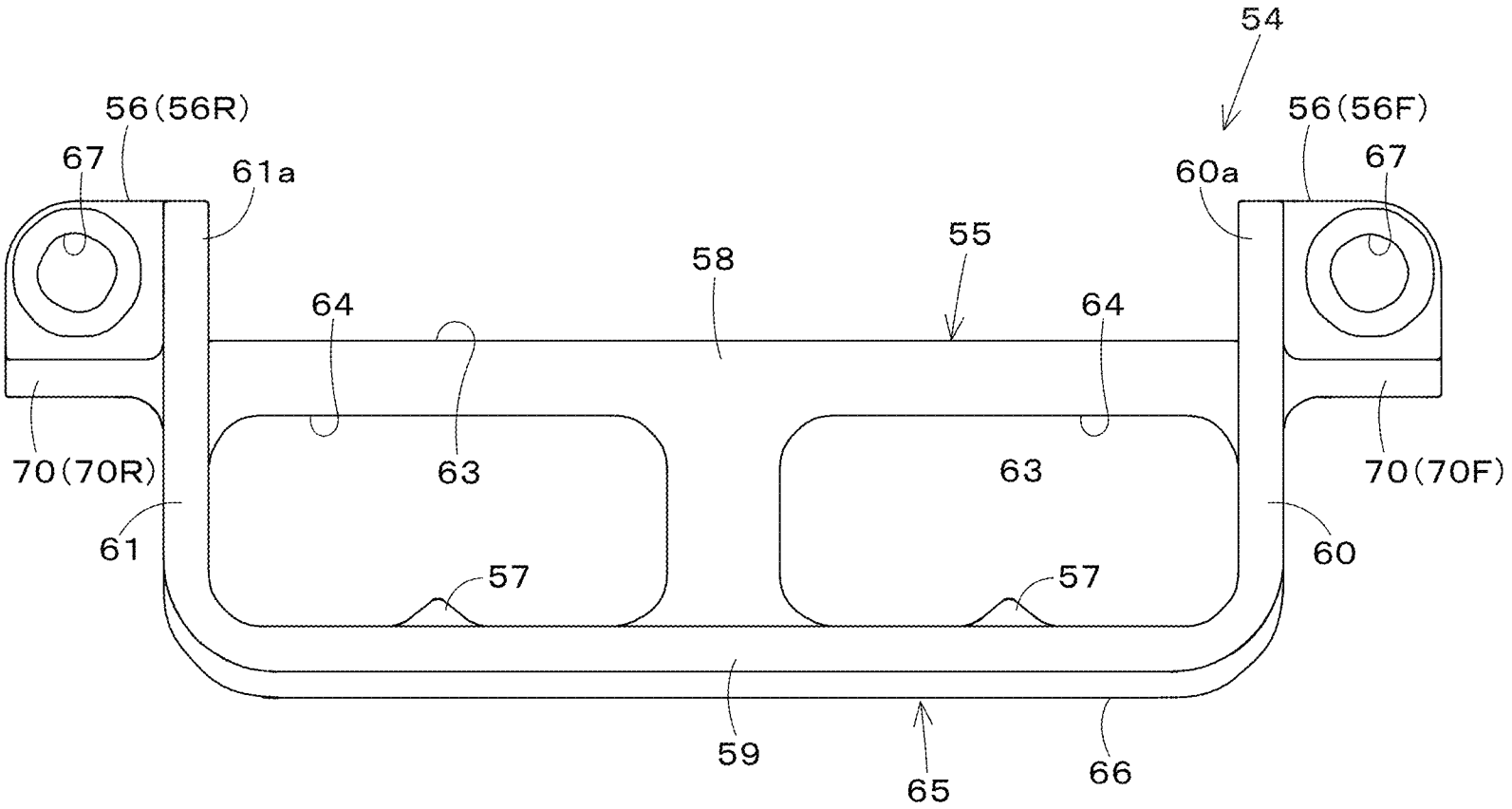
FIG. 12 is a plan view of the battery guard.

As illustrated in FIGS. 10, 11, and 12, the battery guard 54 includes a body 55, at least one stay 56, and at least one engagement portion 57. In the present example embodiment, the battery guard 54 is a cast component, and the body 55, the stay 56, and the engagement portion 57 are integrally molded by casting. The battery guard 54 is not limited to the cast component, and may be made of a sheet metal, a resin, or the like.

As illustrated in FIGS. 10, 11, and 12, the body 55 includes the bottom wall 58, a first vertical wall 59, a second vertical wall 60, and a third vertical wall 61.

Figure 13:
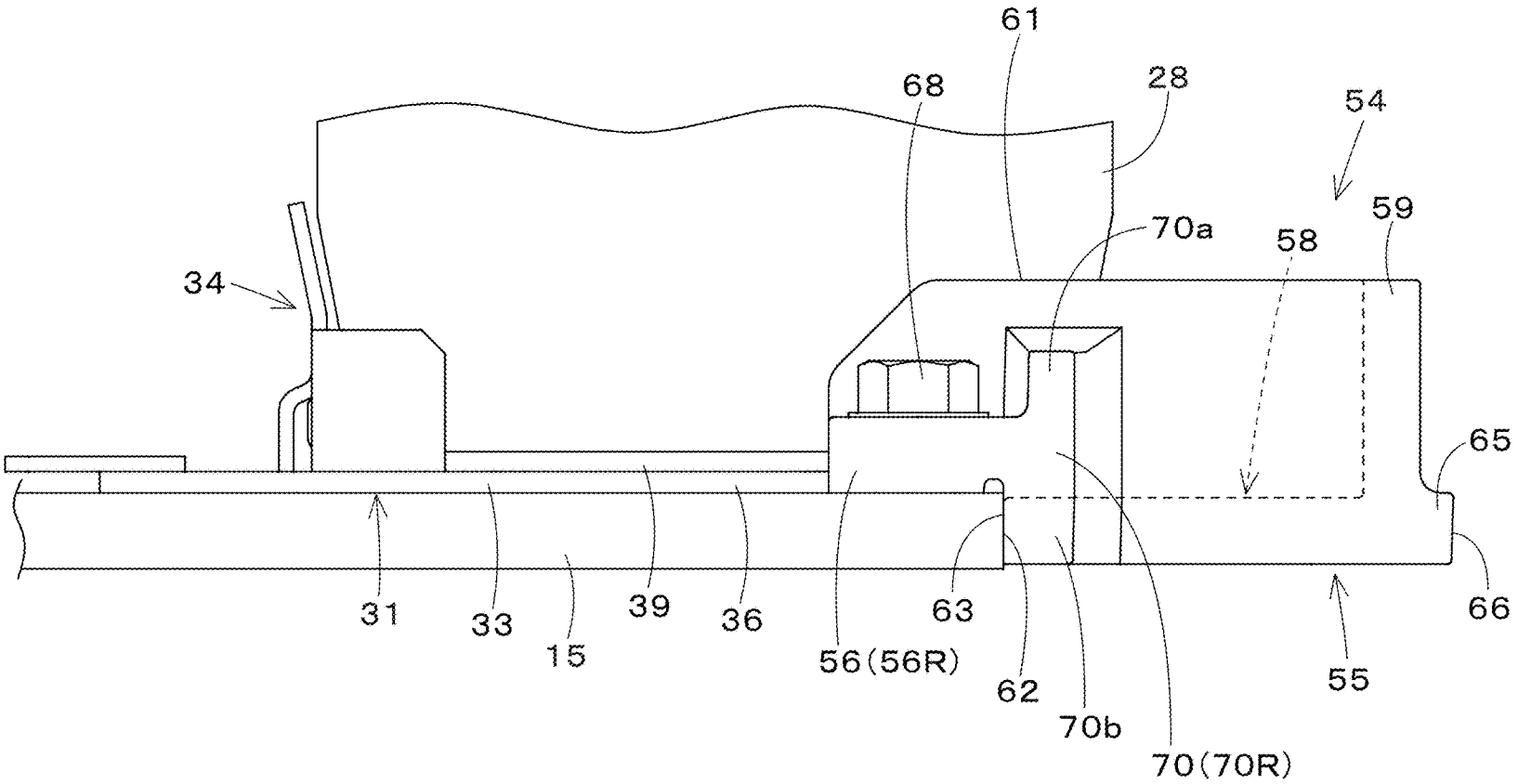

As illustrated in FIG. 13, the bottom wall 58 is provided rightward of a right side surface (referred to as "receiving surface 62") which is one of side surfaces of the swivel board 15 extending along the plate surface (a side surface of the plate member of the swivel board 15 that faces outward in the machine body width direction K2). As illustrated in FIGS. 6 and 9, the bottom wall 58 is provided below the right portion of the stage 36 and the extension 37.

Figure 14:
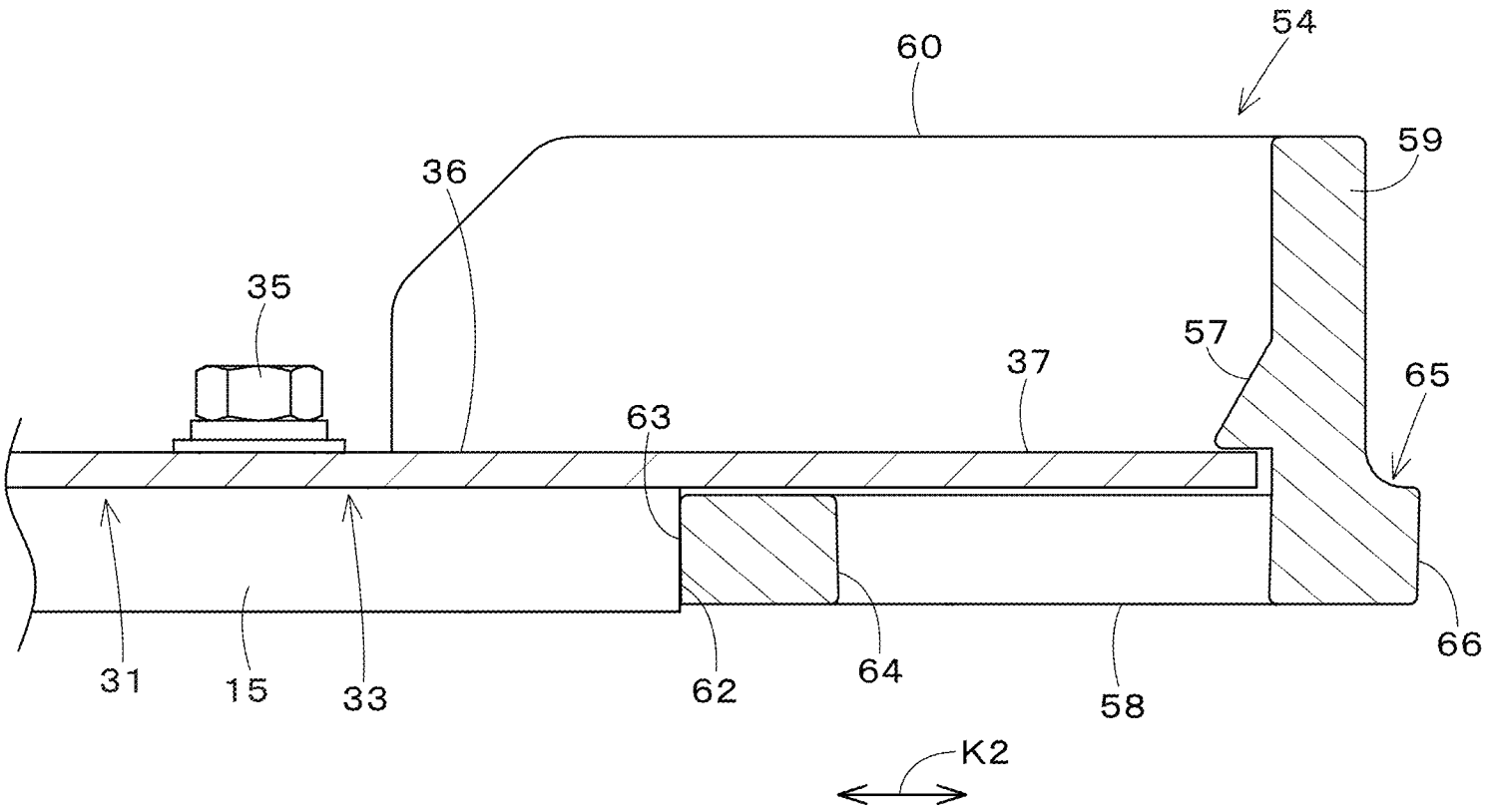

As illustrated in FIGS. 13 and 14, the left surface of the bottom wall 58 is in contact with the receiving surface 62. That is, the left surface of the bottom wall 58 (surface facing inward along the machine body width direction) is a contact portion 63 that is in contact with the receiving surface 62 (swivel board 15). The contact portion 63 is configured to contact the side surface (receiving surface 62, which faces outward along the machine body width direction K2) of the plate member of the swivel board 15 from the outside along the machine body width direction K2 such that a direction in which the contact portion 63 comes into contact with the side surface is perpendicular to or substantially perpendicular to the side surface.

The external impact applied to the battery guard 54 is transmitted from the contact portion 63 to the receiving surface 62 (swivel board 15) and received by the receiving surface 62. That is, the battery guard 54 includes the contact portion 63 that is in contact with the swivel board 15 so that the swivel board 15 receives the impact applied to the battery guard 54.

As illustrated in FIG. 9, the bottom wall 58 has at least one through hole 64 for weight reduction of the battery guard 54.

As illustrated in FIG. 13, the first vertical wall 59 extends upward from the outer end (right portion) of the bottom wall 58 in the machine body width direction. As illustrated in FIG. 6, the first vertical wall 59 is provided at a distance outward of the lower portion of the battery 28 in the machine body width direction. As illustrated in FIG. 10, the first vertical wall 59 has a longitudinal width from one end of the bottom wall 58 in the longitudinal direction K1 to the other end thereof.

As illustrated in FIGS. 3, 9, and 13, the bottom wall 58 includes a protrusion 65 that is an outer (right) portion of the bottom wall 58 in the machine body width direction and protrudes outward (rightward) in the machine body width direction from the first vertical wall 59. As illustrated in FIG. 3, the protrusion 65 is formed from the one end of the bottom wall 58 (first vertical wall 59) in the longitudinal direction K1 to the other end thereof. The right surface of the protrusion 65 (surface facing outward along the machine body width direction) is an impact receiver 66 that receives an external impact. As illustrated in FIG. 7, the impact receiver 66 is located forward of one of the opposite portions (first portion) 20*a* of the weight 20. As illustrated in FIGS. 6 and 7, the impact receiver 66 is located below the rear lower end of the side of the hood 22 and exposed from the hood 22. A cutout 71 is formed at the rear lower end of a side surface of the hood 22.

As illustrated in FIG. 13, the impact receiver 66 is formed at a position corresponding to the contact portion 63 in the horizontal direction. In other words, the impact receiver 66 that is the surface to which the external impact is applied and the receiving surface 62 of the swivel board 15 that is the surface to receive the impact are positionally aligned in the vertical direction (up-down direction).

As illustrated in FIGS. 10 and 12, the second vertical wall 60 extends upward from the front portion of the bottom wall 58 and is connected to the first vertical wall 59. The second vertical wall 60 includes an extended portion 60*a* that is extended to protrude leftward from the bottom wall 58 (inward in the machine body width direction). The third vertical wall 61 extends upward from the rear portion of the bottom wall 58 and is connected to the first vertical wall 59. The third vertical wall 61 includes an extended portion 61*a* that is extended to protrude leftward from the bottom wall 58 (inward in the machine body width direction).

As illustrated in FIG. 9, the right portion of the stage 36 and the extension 37 are located between the second vertical wall 60 and the third vertical wall 61 when viewed from the top.

As illustrated in FIGS. 10 and 12, a plurality of the stays 56 is provided. Specifically, the stays 56 are provided forward and rearward of the body 55. A single stay 56 may be provided. The stay 56 provided forward of the body 55 is referred to as "first stay 56F" and the stay 56 provided rearward of the body 55 is referred to as "second stay 56R."

The first stay 56F extends from the front surface of the second vertical wall 60. Specifically, the first stay 56F extends forward from the extended portion 60*a* of the second vertical wall 60 so that the wall surface is oriented in the up-down direction. The second stay 56R extends from the rear surface of the third vertical wall 61. Specifically, the second stay 56R extends rearward from the extended portion 61*a* of the third vertical wall 61 so that the wall surface is oriented in the up-down direction. The first stay 56F and the second stay 56R have bolt insertion holes 67 passing therethrough in the up-down direction.

As illustrated in FIGS. 3 and 4, the stays 56 (first stay 56F and second stay 56R) are stacked on the swivel board 15, and bolts 68 are inserted through the bolt insertion holes 67 (see FIG. 10) and driven into screw holes 69 (see FIG. 5) formed in the swivel board 15. Thus, the battery guard 54 is attached to the swivel board 15 in a cantilever fashion. The screw holes are holes having external threads on the inner peripheral surfaces.

As illustrated in FIGS. 3, 9, and 10, rib walls 70 are provided at the outside (right) of the first stay 56F and the second stay 56R of the battery guard 54 in the machine body width direction. A front rib wall 70F provided at the right of the first stay 56F extends forward from the front surface of the second vertical wall 60 so that the wall surface is oriented in the machine body width direction K2. The first stay 56F is connected to an intermediate portion of the rib wall 70F in the up-down direction. A rear rib wall 70R provided at the right of the second stay 56R extends rearward from the rear surface of the third vertical wall 61 so that the wall surface is oriented in the machine body width direction K2. The second stay 56R is connected to an intermediate portion of the rib wall 70R in the up-down direction.

As illustrated in FIG. 11, an upper portion 70*a* of the rib wall 70 protrudes upward from the stay 56, and a lower portion 70*b* of the rib wall 70 protrudes downward from the stay 56. The left surface of the lower portion 70*b* of the rib wall 70 is flush with the contact portion 63. Therefore, the left surface of the lower portion 70*b* of the rib wall 70 is in contact with the right side surface of the swivel board 15. Thus, the external impact applied to the battery guard 54 (impact receiver 66) is transmitted to the swivel board 15 via the rib wall 70 and received by the swivel board 15.

As illustrated in FIGS. 10, 11, and 12, a plurality of the engagement portions 57 is provided. Specifically, a pair of front and rear engagement portions 57 is provided. The pair of engagement portions 57 is formed on the surface (left surface) of the first vertical wall 59 that faces inward along the machine body width direction. The pair of engagement portions 57 protrudes inward (leftward) in the machine body width direction from the lower portion of the surface of the first vertical wall 59 that faces inward along the machine body width direction.

As illustrated in FIGS. 6 and 14, the engagement portions 57 are located above the outer portion (right portion) of the extension 37 of the base member 33 in the machine body width direction. The engagement portions 57 can be engaged with (placed on) the mount 31 (extension 37) with the stays 56 stacked on the swivel board 15. By placing the engagement portions 57 on the extension 37, the load of the battery guard 54 can be placed on the mount 31.

As illustrated in FIG. 13, the battery guard 54 is attached in the cantilever fashion by attaching the stays 56 provided at the left of the body 55 to the swivel board 15. Therefore, when attaching the battery guard 54, a user needs to expend much effort to, for example, attach the stays 56 to the swivel board 15 while holding the right portion of the battery guard 54.

In view of this, the stays 56 (first stay 56F and second stay 56R) of the battery guard 54 of the present example embodiment can be attached (the battery guard 54 can be attached) easily by engaging (placing) the engagement portions 57 with (on) the mount 31 (extension 37) and placing the load of the battery guard 54 on the mount 31 with the stays 56 stacked on the swivel board 15. That is, by placing the engagement portions 57 on the extension 37 when attaching the battery guard 54 to the swivel board 15, the user need not attach the battery guard 54 while supporting the battery guard 54. Thus, the effort to attach the battery guard 54 can be reduced.

There is a strong possibility that the external impact is applied to the battery guard 54 (impact receiver 66) in the horizontal direction. In the present example embodiment, the impact receiver 66 and the contact portion 63 are formed at the corresponding positions in the horizontal direction. Therefore, the impact applied to the impact receiver 66 is transmitted in the horizontal direction from the impact receiver 66 to the contact portion 63 and received by the receiving surface 62 of the swivel board 15. Thus, moment acting on the battery guard 54 due to the external impact can be eliminated or reduced. Specifically, if the external impact is applied, for example, to the first vertical wall 59 (above the impact receiver 66), moment in a direction in which the battery guard 54 is pushed downward acts on the battery guard 54. However, such moment can be eliminated or reduced by causing the external impact to be applied to the impact receiver 66.

That is, an outer part of the battery guard 54 in the machine body width direction includes the protruding portion, that is, the protrusion 65, and the surface of the protrusion 65 that faces outward along the machine body width direction is the impact receiver 66. Thus, the impact applied to the battery guard 54 is applied to the impact receiver 66 with priority (an obstacle such as a wall hits with priority). In other words, part of the battery guard 54 has the protruding shape to determine the surface of the battery guard 54 to which the impact is applied (surface against which the obstacle hits). Further, the portion of the battery guard 54 to which the impact is applied (impact receiver 66) and the portion of the swivel board 15 to receive the impact (receiving surface 62) are positionally aligned in the up-down direction to reduce the moment caused by the impact applied to the battery guard 54.

The rigidity of the battery guard 54 of the present example embodiment is improved by the first vertical wall 59, the second vertical wall 60, and the third vertical wall 61. Further, the battery guard 54 has a height at which the lower portion of the battery 28 (below the center of the battery 28 in the up-down direction) is guarded. By reducing the height of the battery guard 54, the weight of the battery guard 54 is reduced.

Figure 15:
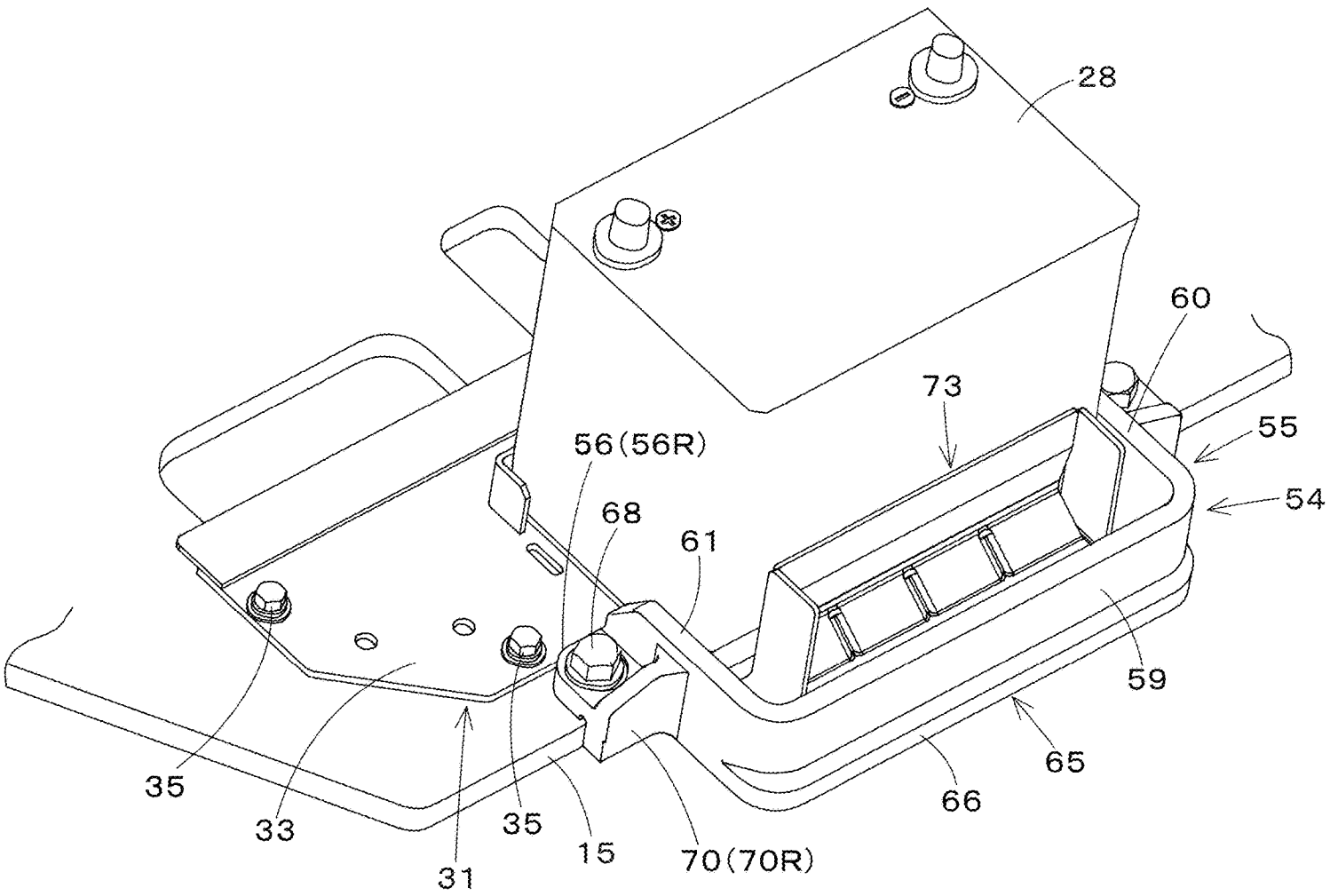
FIG. 15 is a perspective view illustrating another method for attaching the battery.
Figure 16:
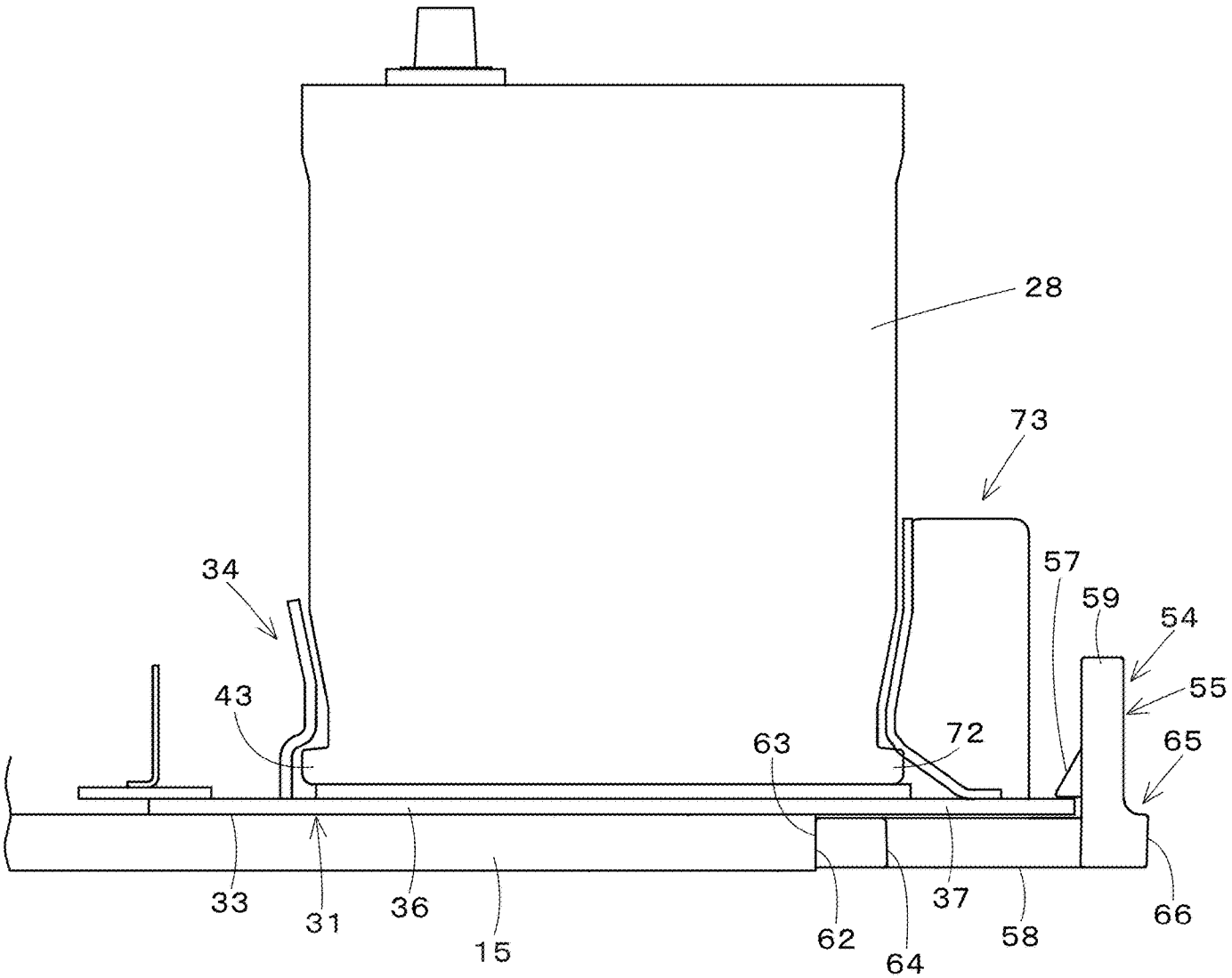
FIG. 16 is a sectional view illustrating the other method for attaching the battery.

FIGS. 15 and 16 illustrate another method for attaching the battery 28.

As illustrated in FIGS. 15 and 16, the restriction member 34 restricts leftward movement, movement in the longitudinal direction K1, and upward movement of the left portion of the battery 28. A holding member 73 restricts upward movement of the right portion of the battery 28. The holding member 73 is provided between the first vertical wall 59 and the battery 28 and between the second vertical wall 60 and the third vertical wall 61, and is fixed to the extension 37 with bolts or the like. A second engagement protrusion 72 is formed at the lower right portion of the battery 28. The holding member 73 holds the second engagement protrusion 72 to restrict upward movement of the right portion of the battery 28. The holding member 73 is guarded by the first vertical wall 59, the second vertical wall 60, and the third vertical wall 61 of the battery guard 54 and the like.

Example embodiments of the present invention provide working machines 1 described in the following items.

(Item 1) A working machine 1 including: a traveling device 3; a machine body 2 turnably supported on the traveling device 3; a device (battery 28) attached to a swivel board 15 defining a bottom of the machine body 2; and a guard member (battery guard 54) provided outward of the device 28 in a machine body width direction to guard the device 28 from an external impact.

With the working machine 1 according to item 1, the guard member 54 provided outward of the device 28 in the machine body width direction can guard the device 28 from the external impact. This makes it possible to reduce the limitation on the position of the device 28.

(Item 2) The working machine 1 according to item 1, wherein the guard member 54 includes a contact portion 63 to contact the swivel board 15 such that the swivel board 15 receives the impact applied to the guard member 54.

With the working machine 1 according to item 2, the external impact applied to the device 28 can be received by the swivel board 15.

(Item 3) The working machine 1 according to item 2, wherein the guard member 54 includes an impact receiver 66 to receive the impact, and the impact receiver 66 is provided at a position corresponding to the contact portion 63 in a horizontal direction.

With the working machine 1 according to item 3, the impact applied to the impact receiver 66 can efficiently be transmitted to the swivel board 15.

(Item 4) The working machine 1 according to item 2 or 3, wherein the swivel board 15 includes a plate member and is positioned such that a plate surface thereof faces in an up-down direction, and the contact portion 63 is configured to contact a side surface (receiving surface 62) of the plate member from an outside along the machine body width direction K2 such that a direction in which the contact portion 63 comes into contact with the side surface 62 is perpendicular to or substantially perpendicular to the side surface 62, the side surface facing outward along the machine body width direction K2.

With the working machine 1 according to item 4, the external impact applied to the guard member 54 can suitably be received by the swivel board 15.

(Item 5) The working machine 1 according to any one of items 1 to 4, wherein the guard member 54 protrudes in a first direction along the machine body width direction K2 from a first one of opposite sides of the swivel board 15 in the machine body width direction K2, and is located inward along the machine body width direction K2 of a first one of opposite sides of the traveling device 3 in the machine body width direction K2.

With the working machine 1 according to item 5, even though the guard member 54 protrudes in one direction along the machine body width direction K2 from one of opposite sides of the swivel board 15 in the machine body width direction K2, it is possible to eliminate or reduce the likelihood that the guard member 54 will contact an obstacle when, for example, the machine body 2 does not swivel.

(Item 6) The working machine 1 according to any one of items 1 to 5, wherein the guard member 54 includes a bottom wall 58 located downstream, in a first direction along the machine body width direction K2, of a first one of opposite sides of the swivel board 15 in the machine body width direction K2, and a portion of the device 28 is placed on the bottom wall 58 such that the portion is located downstream, in the first direction along the machine body width direction K2, of the first one of the opposite sides of the swivel board 15 in the machine body width direction K2.

With the working machine 1 according to item 6, the device 28 can be protected in cases where the device 28 is partially located downstream, in the first direction along the machine body width direction K2, of the first one of the opposite sides of the swivel board 15 in the machine body width direction K2.

(Item 7) The working machine 1 according to item 3 or according to item 4, 5, or 6 taken in combination with item 3, wherein the device 28 is provided at one of opposite widthwise outer portions of the swivel board 15 in the machine body width direction, the guard member 54 includes a bottom wall 58 and a first vertical wall 59 extending upward from an outer one of opposite sides of the bottom wall 58 in the machine body width direction, the bottom wall 58 includes a protrusion 65 that is one of opposite widthwise outer portions of the bottom wall 58 in the machine body width direction and protrudes outward along the machine body width direction relative to the first vertical wall 59, the impact receiver 66 includes a surface of the protrusion 65 that faces outward along the machine body width direction, and the contact portion 63 includes a surface of the bottom wall 58 that faces inward along the machine body width direction.

With the working machine 1 according to item 7, it is possible to allow the external impact applied to the guard member 54 to first act on the impact receiver 66, and possible to allow the external impact to suitably act on the swivel board 15.

(Item 8) The working machine 1 according to item 7, wherein the guard member 54 includes a second vertical wall 60 extending upward from a front portion of the bottom wall 58 and connected to the first vertical wall 59, and a third vertical wall 61 extending upward from a rear portion of the bottom wall 58 and connected to the first vertical wall 59.

With the working machine 1 according to item 8, the rigidity of the guard member 54 can be improved.

(Item 9) The working machine 1 according to any one of items 1 to 8, further including a mount 31 attached to the swivel board 15, the mount being configured to have the device 28 placed and attached thereon, wherein the guard member 54 includes: at least one stay 56 stacked on and attached to the swivel board 15; and an engagement portion 57 to engage with the mount 31 to place a load of the guard member 54 on the mount 31 when the stay 56 is stacked on the swivel board 15.

With the working machine 1 according to item 9, when the user attaches the guard member 54 to the swivel board 15, the user does not need to perform the attaching operation while supporting the guard member 54. This makes it possible to reduce the effort to attach the guard member 54.

(Item 10) The working machine 1 according to item 9, wherein the guard member 54 includes a bottom wall 58 and a first vertical wall 59 extending upward from an outer one of opposite sides of the bottom wall 58 in the machine body width direction, a plurality of the stays 56 are provided, the plurality of the stays 56 include: a first stay 56F extending from a front surface of a second vertical wall 60 and stacked and attached on the swivel board 15; and a second stay 56R extending from a rear surface of a third vertical wall 61 and stacked and attached on the swivel board 15, and the engagement portion 57 is provided on a surface of the first vertical wall 59 that faces inward along the machine body width direction.

With the working machine 1 according to item 10, the guard member 54 can be suitably supported when the stay 56 is attached to the swivel board 15.

(Item 11) The working machine 1 according to any one of items 1 to 10, further including a weight 20 provided at a rear portion of the swivel board 15, wherein the device 28 is located at one of opposite portions of the rear portion of the swivel board 15 in the machine body width direction K2 and located forward of one of opposite portions (first portion 20*a*) of the weight 20 in the machine body width direction K2.

With the working machine 1 according to item 11, even though the device 28 is provided forward of one of the opposite portions of the weight 20 in the machine body width direction K2, the device 28 can be guarded by the guard member 54. Thus, the device 28 can be provided forward of the one of the opposite portions of the weight 20 in the machine body width direction K2.

(Item 12) The working machine 1 according to any one of items 1 to 11, wherein the device 28 includes a battery.

With the working machine 1 according to item 12, it is possible to reduce the limitation of the position of the battery 28.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:
- a traveling device;
- a machine body turnably supported on the traveling device;
- a device attached to a swivel board defining a bottom of the machine body; and
- a guard member provided outward of the device in a machine body width direction to guard the device from an external impact; wherein
- the guard member includes:
  - a contact portion to contact the swivel board such that the swivel board receives the impact applied to the guard member; and
  - an impact receiver to receive the impact; and
- the impact receiver is provided at a position corresponding to the contact portion in a horizontal direction.

2. The working machine according to claim 1, wherein the guard member
- protrudes in a first direction along the machine body width direction from a first one of opposite sides of the swivel board in the machine body width direction; and
- is located inward along the machine body width direction of a first one of opposite sides of the traveling device in the machine body width direction.

3. The working machine according to claim 1, wherein
- the device is provided at one of opposite widthwise outer portions of the swivel board in the machine body width direction;
- the guard member includes a bottom wall and a first vertical wall extending upward from an outer one of opposite sides of the bottom wall in the machine body width direction,
- the bottom wall includes a protrusion that is one of opposite widthwise outer portions of the bottom wall in the machine body width direction and protrudes outward along the machine body width direction relative to the first vertical wall;
- the impact receiver includes a surface of the protrusion that faces outward along the machine body width direction; and
- the contact portion includes a surface of the bottom wall that faces inward along the machine body width direction.

4. The working machine according to claim 3, wherein the guard member includes a second vertical wall extending upward from a front portion of the bottom wall and connected to the first vertical wall, and a third vertical wall extending upward from a rear portion of the bottom wall and connected to the first vertical wall.

5. The working machine according to claim 1, further comprising a mount attached to the swivel board, the mount being configured to have the device placed and attached thereon; wherein
- the guard member includes:
  - at least one stay stacked on and attached to the swivel board; and
  - an engagement portion to engage with the mount to place a load of the guard member on the mount when the stay is stacked on the swivel board.

6. The working machine according to claim 5, wherein
- the guard member includes a bottom wall, a first vertical wall extending upward from an outer one of opposite sides of the bottom wall in the machine body width direction, a second vertical wall extending upward from a front portion of the bottom wall and connected to the first vertical wall, and a third vertical wall extending upward from a rear portion of the bottom wall and connected to the first vertical wall;
- a plurality of the stays are provided;
- the plurality of the stays include:
  - a first stay extending from a front surface of the second vertical wall and stacked and attached on the swivel board; and
  - a second stay extending from a rear surface of the third vertical wall and stacked and attached on the swivel board; and
- the engagement portion is provided on a surface of the first vertical wall that faces inward along the machine body width direction.

7. The working machine according to claim 1, further comprising a weight provided at a rear portion of the swivel board; wherein
- the device is located at one of opposite portions of the rear portion of the swivel board in the machine body width direction and located forward of one of opposite portions of the weight in the machine body width direction.

8. The working machine according to claim 1, wherein the device includes a battery.

9. A working machine comprising:
- a traveling device;

a machine body turnably supported on the traveling device;

a device attached to a swivel board defining a bottom of the machine body; and a guard member provided outward of the device in a machine body width direction to guard the device from an external impact; wherein the guard member includes a contact portion to contact the swivel board such that the swivel board receives the impact applied to the guard member;

the swivel board includes a plate member and is positioned such that a plate surface thereof faces in an up-down direction; and the contact portion is configured to contact a side surface of the plate member from an outside along the machine body width direction such that a direction in which the contact portion comes into contact with the side surface is perpendicular to or substantially perpendicular to the side surface, the side surface facing outward in the machine body width direction.

10. A working machine comprising:

a traveling device;

a machine body turnably supported on the traveling device;

a device attached to a swivel board defining a bottom of the machine body; and a guard member provided outward of the device in a machine body width direction to guard the device from an external impact; wherein the guard member includes a bottom wall located downstream, in a first direction along the machine body width direction, of a first one of opposite sides of the swivel board in the machine body width direction; and a portion of the device is placed on the bottom wall such that the portion is located downstream, in the first direction along the machine body width direction, of the first one of the opposite sides of the swivel board in the machine body width direction.

* * * * *